US006010031A

United States Patent [19]

Fox

[11] Patent Number: 6,010,031

[45] Date of Patent: Jan. 4, 2000

[54] APPARATUS FOR DISPENSING ARTICLES WITH INFORMATION THEREON

[76] Inventor: Melody A. Fox, 80 S. Linden, Ventura, Calif. 93004

[21] Appl. No.: 09/021,188

[22] Filed: Feb. 10, 1998

[51] Int. Cl.[7] ..... B65H 1/00; B65G 59/00

[52] U.S. Cl. ..... 221/34; 221/283

[58] Field of Search ..... 221/279, 281, 221/283; 312/245, 249.3, 8.15

[56] References Cited

U.S. PATENT DOCUMENTS

| | | | |
|---|---|---|---|
| 1,719,338 | 7/1929 | Parker | 221/62 X |
| 2,616,554 | 11/1952 | Wade et al. . | |
| 3,146,739 | 9/1964 | Furman | 221/245 X |
| 3,189,219 | 6/1965 | Holzworth et al. | 221/281 X |
| 4,471,885 | 9/1984 | Mucciarone . | |
| 4,779,759 | 10/1988 | Seavey | 221/281 X |
| 5,337,897 | 8/1994 | Yablans | 221/279 X |
| 5,427,273 | 6/1995 | Vine | 221/283 X |
| 5,645,203 | 7/1997 | Tappenden . | |
| 5,752,622 | 5/1998 | Abell | 221/283 X |

*Primary Examiner*—William E. Terrell
*Assistant Examiner*—Gene O. Crawford
*Attorney, Agent, or Firm*—Woodrow Douglas English; Milord Keshiszadeh, J.D.

[57] ABSTRACT

An apparatus for dispensing articles bearing information thereon that is made of a box like container having a hinged lid for loading articles such as business cards. The front side of the box, opposite the hinged side, is slightly shorter than the other sides, whereby a slit is formed between the lid and the front side. A spring biasing means is attached to the bottom of the box and lifts a supporting surface and the business cards towards the lid. Interested individuals may remove the cards through the slit and the spring biasing means will replenish the cards.

20 Claims, 2 Drawing Sheets

APPARATUS FOR DISPENSING ARTICLES WITH INFORMATION THEREON

FIELD OF THE INVENTION

The invention relates to an apparatus for dispensing articles bearing information thereon, and more particularly to a portable, yet securable, apparatus for dispensing business cards to interested individuals.

DISCUSSION OF THE PRIOR ART

Although article dispensing apparatus have been known for many years, they have failed to protect the articles contained therein from the elements, they have failed to prevent individuals from absconding with the apparatus, and they have not been easily mountable to a variety of surfaces. Therefore, there is a long-standing and continuing need for an article dispensing apparatus that protects the articles contained therein from the elements, that can be securely attached to prevent theft of the apparatus, that can easily be reloaded with articles, and is still portable and easily mounted on a variety of surfaces.

For example, U.S. Pat. No. 2,616,554, issued to Wade et al. discloses a coin holder for use on automobiles. The invention was made in the more innocent era of 1952, wherein an easily removable coin holder, containing stacks of coins of different denominations, could be attached to the outside of a vehicle without it being stolen. The invention is removably attached to a vehicle by only inserting a mounting tongue into the molding surrounding the windshield of a vehicle. The contents of the invention are exposed to the elements and to the will of amoral individuals who may abscond with the contents or the entire invention itself.

Another patent, U.S. Pat. No. 4,471,885, issued to Mucciarone discloses a box that selectively displays and stores information contained on a stack of reusable cards. The invention complex loading and a shuttle dispensing mechanism which may be susceptible to failure and may damage the information cards. The invention is not securable attachable and may be easily stolen; furthermore, the invention is limited in mounting options and can only be displayed on a level surface.

Finally, U.S. Pat. No. 5,645,203, issued to Tappenden discloses a business card dispensing holder that is limited in its display form. The invention may only be mounted on the windshield of a vehicle or screwed into the body of a vehicle; however, the invention cannot be attached to or placed on any other surfaces. Furthermore, the cards are exposed to the elements and may be damaged by dirt, snow, or rain.

In view of the prior art, there remains a long standing and continuing need for an advance in the art beyond the existing art of article dispensing apparatus that is simpler and economical in design and more easy and reliable in use. Furthermore, there remains a long standing and continuing need for an article dispensing apparatus that is securably, yet removably, attachable in a various number of mounting positions that protects the articles contained therein from the elements.

SUMMARY OF THE INVENTION

The present invention eliminates the deficiencies of the prior art. The present apparatus has a front wall and a back wall interconnected by two side walls, which are all attached to a bottom. A top is hingedly attached to the back wall and is maintained in a normally closed position by contractile elements which attach the top to the side walls. A pair of bias elements are attached to the bottom at one end and are also attached to a supporting surface at their opposing end. A stack of articles containing information are placed upon the supporting surface and are elevated towards the top. The front wall is slightly shorter than the other walls thereby forming a slit between the front wall and the top. In addition, the top may have an excised portion to allow an individual's finger to contact the contained articles. An article may now be removed from the slit and additional articles are elevated to a position such that the new article may now be removed.

The apparatus may be placed on a surface, such as a counter, or may be mounted onto a vertical surface by adhesive means administered to an outer surface of the back wall. Preferably, the apparatus is used in conjunction with a mounting cradle. The mounting cradle has a back surface and is flanged at both ends. The back surface has at least one aperture through which a nail or screw may be inserted and thereby mounted onto a desired surface. The side walls of the apparatus each have configurations which fit into the flanges of the mounting cradle and is thereby maintained. A locking mechanism may be used to attach the apparatus to the mounting cradle to prevent the theft thereof

OBJECTS OF THE INVENTION

It is, accordingly, an object of the present invention is to overcome disadvantages of the prior art and more particularly, it is an object of this invention to provide an improved article dispensing apparatus that can be placed on any horizontal surface.

Another object of the invention is to provide an improved article dispensing apparatus that can be easily attached to any vertical surface.

Another object of the invention is to provide an improved article dispensing apparatus that is portable, yet it can be securely attached to any surface to prevent theft thereof.

A further object of the invention is to provide an improved article dispensing apparatus that protects the articles from damage by the elements.

Other objects, advantages, and novel features of the invention will become more readily apparent from the following detailed description of the invention when considered in the light of the accompanying drawings and appended claims.

DETAILED DESCRIPTION OF THE PREFERRED EMBODIMENT

The following is a description of the best mode of implementing the concept of the invention. This description is given only to illustrate the general principles of the invention and is not to be interpreted in a limiting sense. The true scope and further extent of the invention can only be ascertained by reading the appended claims.

Figure 1:
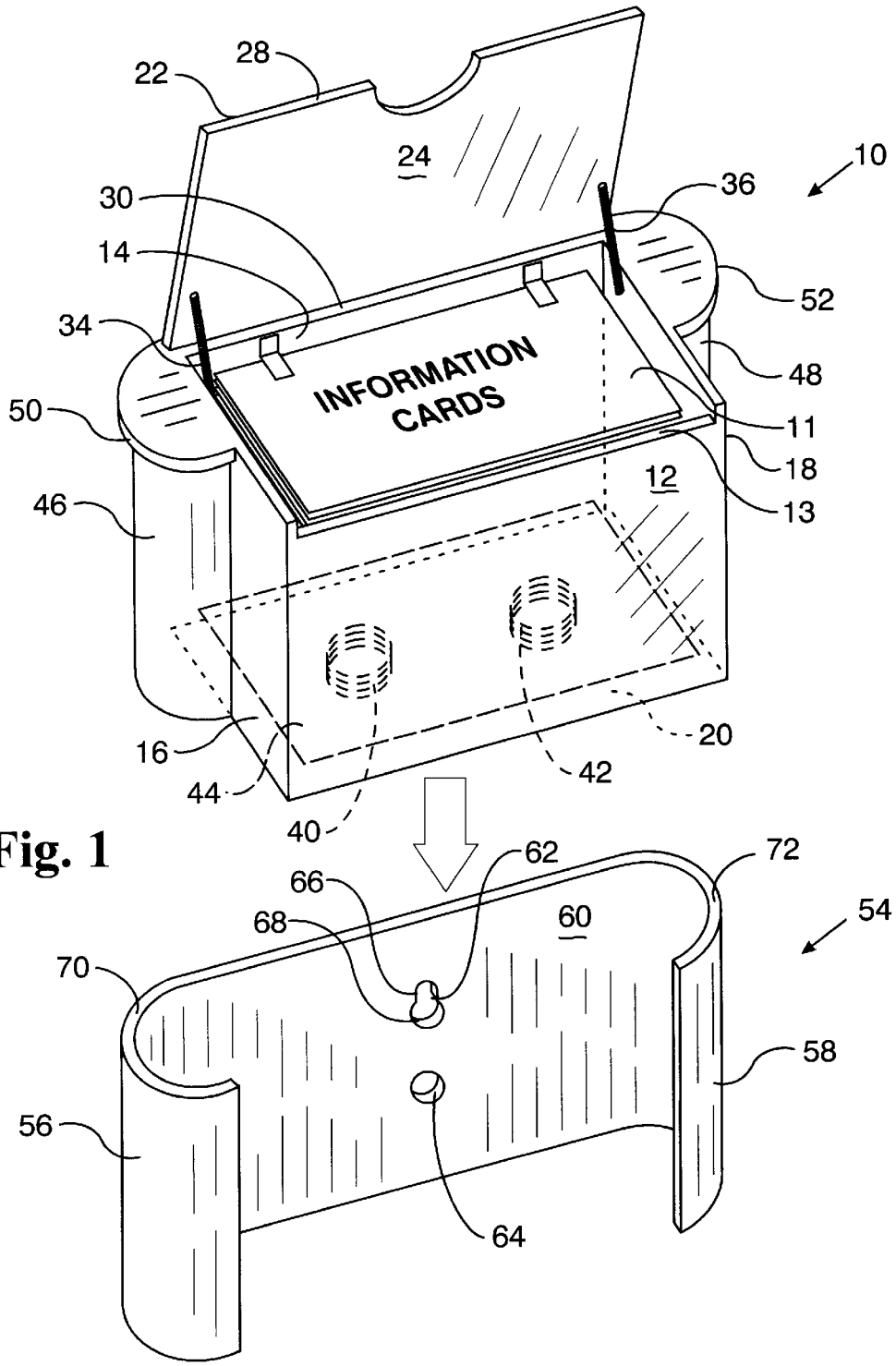
FIG. 1 is a perspective view of the article dispensing apparatus and the mounting cradle in an unassembled position.

Referring now to FIG. 1, an apparatus 10 for dispensing a plurality of articles 11 having information thereon is illustrated. Information articles 11 preferably consist of conventional business cards. Apparatus 10 may be made of any substantially rigid material such as, but not limited to, metal, plastic, or wood, or any combination thereof. Apparatus 10 has a front side 12 and a back side 14 which are interconnected by a first side wall 16 and a second side wall 18. A bottom 20 and an adjustable top 22 are connected to side walls 16 and 18, front side 12, and back side 14.

Top 22 has an underside 24 and an upper-side 26 defined by a first edge 28 and a second edge 30. Second edge 30 is hingedly attached to back side 14 to allow top 22 to fluctuate between an open and closed position. Underside 24 has a pair of contractile elements 34 and 36 extending therefrom. Contractile element 34 attaches to first side wall 16 and contractile element 36 attaches to each second side wall 18 respectively, thereby maintaining top 22 in a normally closed position, as more clearly illustrated in FIG. 2. In the closed position, articles 11 are protected from the elements but may still be easily dispensed. First edge 28 of top 22 has an excised portion 38 allowing access to information articles 11 contained within apparatus 10. In addition, front side 12 is slightly shorter than side walls 16 and 18, thereby forming a slit 13 to allow unconstrained dispensation of information articles 11.

A pair of bias elements 40 and 42, which may be made of conventional springs, have one end attached to bottom 20, and have their opposite end attached to a supporting surface 44. Information articles 11 rest on supporting surface 44 and are continuously elevated towards top 22 as individual information articles 11 are removed from slit 13. To load additional information articles 11, top 22 is maintained in an open position, articles 11 are placed upon supporting surface 44 which is forced down until filled, and top 22 is once again closed by contractile elements 34 and 36. A securing means 80 may be used to securely lock top 22 to side wall 16.

A first configuration 46 is attached to first side wall 16, and a second configuration 48 is attached to second side wall 18. Each of said configurations 46 and 48 have an overhanging stopper portion 50 and 52 respectively. Although apparatus 10 may be affixed to a wall using any adhesive method or just placed on a flat surface, apparatus 10 is preferably used in conjunction with a housing cradle 54. Housing cradle 54 has a first flange 56 and a second flange 58 extending from a back surface 60. Back surface 60 defines both a first aperture 62 and a second aperture 64. First aperture 62 has a top portion 66 which is narrower than a bottom portion 68, thus allowing removable mounting of housing cradle 54 on either a screw or nail emanating from a surface, as is well known in the art. Second aperture 64 allows permanent and secure attachment of cradle 54 by inserting either a shaft of either a screw or a nail through said aperture 64 and affixing it to a desired surface. Cradle 54 may also be attached to a desired surface through any adhesive means that is known in the art.

Figure 2:
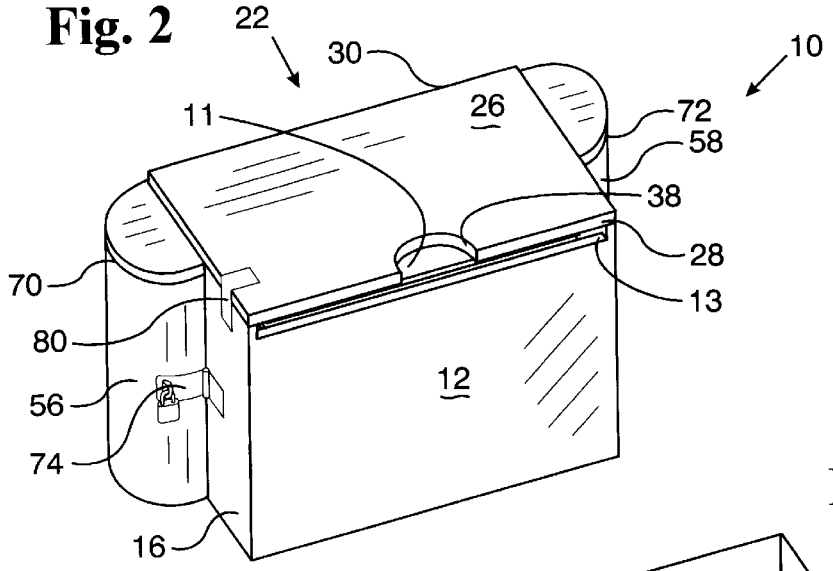
FIG. 2 is a perspective view of the article dispensing apparatus and the mounting cradle in the mounted position.

As more clearly illustrated in FIG. 2, after cradle 54 is attached to a desired surface, first configuration 46 and second configuration 48 are received in first flange 56 and second flange 58 respectively. Stopper portions 50 and 52 rest upon a first top 70 and a second top 72 of first flange 56 and second flange 58 respectively, thereby, apparatus 10 is maintained within cradle 54. A locking mechanism 74 attaches apparatus 10 to cradle 54 to prevent individuals from absconding with said apparatus 10.

Figure 3:
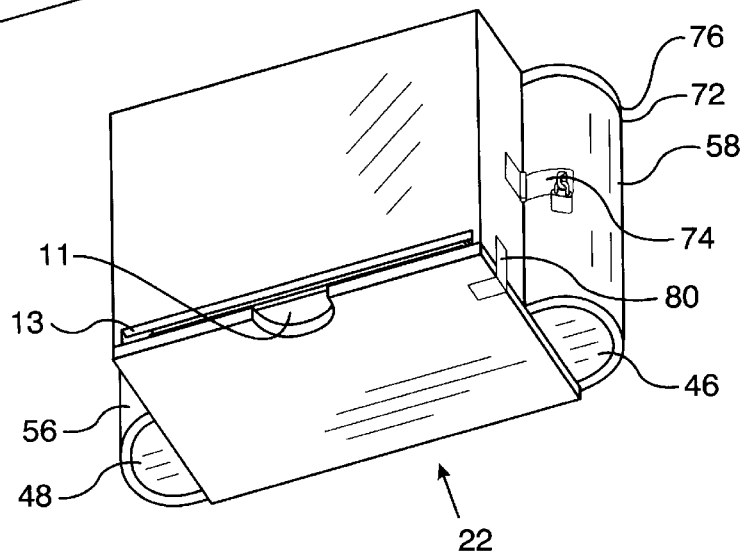
FIG. 3 is a perspective view of an alternate embodiment of the article dispensing apparatus and the mounting cradle in the mounted position wherein the articles are dispensed from the bottom.

Now referring to FIG. 3, an alternative embodiment of apparatus 10 is illustrated. Apparatus 10 is inserted into cradle 54 with top 22 oriented downwards. A restraint 76 emanating from first configuration 46 securely holds apparatus 10 within cradle 54. Articles 11 are still easily dispensed from slit 11; more over, the upside down orientation of apparatus 10 prevents penetration by the elements.

Figure 4:
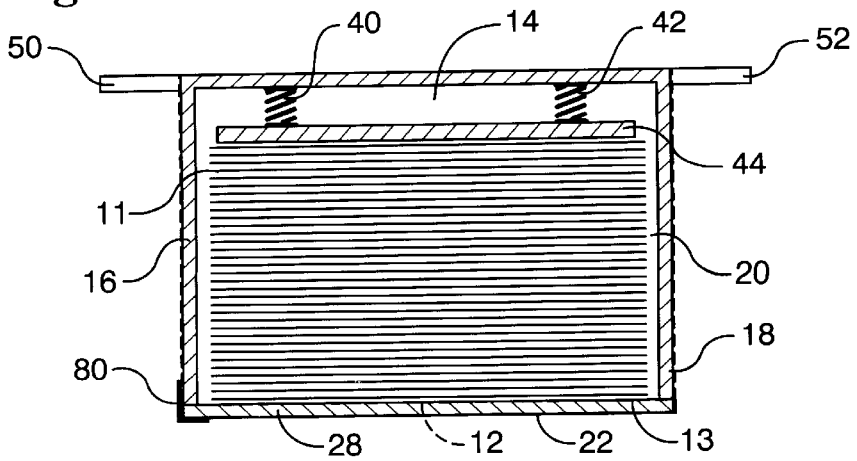
FIG. 4 is a top plan view of an alternate embodiment of the article dispensing apparatus wherein the articles are vertically stored within the apparatus.

Now referring to FIG. 4, a top plan view of an alternative embodiment is illustrated. Bias elements 40 and 42 now emanate from back side 14 and maintain supporting surface 44 in a vertical plain. Additionally, articles 11 are also maintained in a vertical plain and rest against supporting surface 44 and are advanced towards front side 12. Top 22 has a slightly shorter width than bottom 20, thereby slit 13 is formed between first edge 28 of top 22 and front side 12. Articles 11 may now be dispensed from slit 13 in a vertical fashion. Apparatus 10 is mounted onto cradle 54 as previously described above.

While the invention herein disclosed has been described by means of a specific embodiment and application thereof, numerous modifications, and variations could be made thereto by those skilled in the art without departing from the spirit and scope of the present invention. Accordingly, the scope of the invention should be determined not by the embodiments illustrated, but by the appended claims and their legal equivalents.

What is claimed is:

1. An article dispensing apparatus that is removably, yet securely, attachable to any solid surface, comprising:

said apparatus having a front wall having a slit, a back wall interconnected to said front wall by a first side wall and a second side wall, a bottom surface attached to all of said walls, and a top surface covering all of said walls;

at least a resilient means connecting said top surface to any of said walls;

a bias element having a first end and a second end, a supporting surface attached to said first end of said bias element, and the second end of said bias element attaching to said bottom surface;

a plurality of articles resting upon said supporting surface;

said bias element forcing said supporting surface and said articles towards the top surface to allow dispensation of the articles through said slit.

2. The invention of claim 1, wherein said apparatus is received in a mounting cradle having a back surface, said back surface defining at least an aperture, said mounting cradle having a first flange and a second flange for receiving said apparatus.

3. The invention of claim 2 wherein said mounting cradle is attached to a surface using an adhesive means.

4. The invention of claim 2, wherein said mounting cradle is attached to a surface using an attaching means selected from the group consisting of a screw, a nail and a bolt.

5. The invention of claim 2, wherein a first locking means securely attaches said apparatus to said mounting cradle.

6. The invention of claim 2, wherein said apparatus and said mounting cradle are made of at least a substance selected from the group consisting of metal, wood, and plastic.

7. The invention of claim 1, wherein said top surface is attached to said first side wall by a first resilient means and said top surface is attached to said second side wall by a second resilient means, whereby said top surface is normally maintained in a closed position, yet may be opened to insert additional articles.

8. The invention of claim 1, wherein said first side wall has a first configuration and said second side wall has a second configuration, said first configuration and said second configuration being received in a first flange and a second flange of a mounting cradle respectively.

9. The invention of claim 4, wherein at least one of said configurations has a stopper portion which rests upon an edge of at least one of said flanges, whereby said stopper maintains said apparatus within said mounting cradle.

10. The invention of claim 1, wherein said top surface has a second edge ending next to the front wall, said second edge having an excised portion whereby access to said articles is facilitated.

11. The invention of claim 1, wherein said front wall is slightly shorter than said adjoining side walls, whereby said slit is created between said top surface and said front wall and dispensation of said articles is facilitated.

12. The invention of claim 1, wherein a second locking means securely maintains said top surface in a closed position.

13. The invention of claim 1, wherein said top surface has a back edge hingedly attached to said back wall to allow said top surface to fluctuate between an open and closed position.

14. A container for dispensing articles, comprising:

a mounting cradle having a wall, said wall defining at least one aperture, said wall having a first binding portion and a second binding portion at opposing ends, said binding portions receiving said container, and a first locking means for securely, yet removably, attaching said container to said cradle;

a four sided frame, wherein at least a side defines a slit;

a first surface hingedly attached to a first side of said frame, and said first surface being large enough to cover all four sides when in a closed position, and a second locking means securely, yet removably, attaching said first surface to at least a side;

a contractile element attaching said first surface to a side of said frame immediately adjacent to said first side of said frame, to normally maintain said first surface in a normally closed position, yet allowing said first surface to be opened, a second surface attached to all four sides of said frame at an opposing at an opposite end to that of said first surface, a biasing means having a first end attached to said second surface and a second end attached to a supporting surface, a plurality of articles resting upon said supporting surface;

said biasing means continually forces said supporting surface and said articles towards said first surface where said articles may be removed from said slit.

15. The invention of claim 14, wherein said a second side opposing said hinged first side is slightly shorter than all other sides, and said second side and said first surface form said slit through which said articles may be removed.

16. The invention of claim 14, wherein said first surface has an excised portion at an edge opposing said hinged attachment to allow facilitated grasping of said articles.

17. The invention of claim 14, wherein said biasing means is a coiled spring.

18. The invention of claim 14, wherein said first and second locking means are comprised of a conventional latch and lock mechanisms.

19. The invention of claim 14, wherein a first and second configuration are attached to two of said sides opposing one another respectively, each of said configurations being received in said first binding portion and said second binding portion of said cradle respectively.

20. An article dispensing container, comprising:

a mounting cradle having a wall, said wall defining at least one aperture to be used to mount said cradle to a desired surface, said wall having a first flange and a second flange for receiving said container, and a first locking means for securely, yet removably, attaching said cradle to said container;

said container having a front side and a back side interconnected by a left side and a right side, a bottom surface attaching to all said sides, a top surface having a back edge, said back edge being hingedly attached to said back side, and said top surface being slightly shorter than said left and right sides to form a slit between a front edge of said top surface and said front side;

said front side having an excised portion next to said top surface to allow unabated access to s plurality of articles maintained within said container, at least one of said left side and right side having a contractile element attaching said top surface to at least one of said sides to maintain said top surface in a normally closed position;

a second locking means for securely, yet removably, attaching said top surface to at least one of said left and right sides;

at least one biasing means having a first end attached to said back side and a second end attached to a pushing surface, said pushing surface being disposed behind a plurality of said articles being maintained in a vertical orientation, said biasing means forces said articles towards said front side and said slit where the articles may be removed by an interested individual.

* * * * *